United States Patent [19]

Sandoval et al.

[11] 4,266,765

[45] May 12, 1981

[54] APPARATUS FOR AIDING PATIENTS TO AMBULATE

[76] Inventors: Narciso Sandoval; Jean L. Curten, both of 1175 Blaine St., No. 87, Riverside, Calif. 92507

[21] Appl. No.: 27,030

[22] Filed: Apr. 4, 1979

[51] Int. Cl.[3] ..... A61H 3/04

[52] U.S. Cl. ..... 272/70.3; 280/47.37 R

[58] Field of Search ..... 272/70.3, 70.4; 280/11, 280/400, 47.34, 47.35, 47.37 R; 128/25 R, 214 R, 674

[56] References Cited

U.S. PATENT DOCUMENTS

| | | | |
|---|---|---|---|
| D. 115,352 | 6/1939 | Scudder | 280/47.35 X |
| 2,560,059 | 7/1951 | Young | 280/47.35 |
| 2,624,483 | 1/1953 | Ketzel | 280/47.35 X |
| 2,813,727 | 11/1957 | Whalen | 280/47.34 X |
| 3,162,462 | 12/1964 | Elders | 280/47.35 |
| 3,298,367 | 1/1967 | Bergman | 128/214 R |
| 3,704,025 | 11/1972 | Cerveny et al. | 280/47.34 X |
| 3,857,579 | 12/1974 | Hoodenpyle | 280/47.34 X |
| 3,944,241 | 3/1976 | Epelbaum | 280/47.37 R X |

FOREIGN PATENT DOCUMENTS

| | | | |
|---|---|---|---|
| 561592 | 10/1932 | Fed. Rep. of Germany | 280/47.34 |
| 1048148 | 11/1966 | United Kingdom | 272/70.3 |

*Primary Examiner*—Richard C. Pinkham
*Assistant Examiner*—Arnold W. Kramer
*Attorney, Agent, or Firm*—John H. Crowe; Fred N. Schwend

[57] ABSTRACT

A combined patient support and carrier for body servicing devices, the apparatus having a platform supported by wheels, certain of which are castered. A vertical frame at the rear of the platform carries handles for both steadying an infirm or convalescing patient and for enabling the patient to maneuver the apparatus. The platform and frame provide a mobile support for various servicing devices which are required for servicing the patient at all times, even while he or she is walking. The platform is provided with an attachment for removably attaching an auxiliary carrier thereto for carrying an additional body servicing device. The auxiliary carrier is supported by castered wheels whereby the patient can maneuver both the platform and the auxiliary carrier as a single unit.

3 Claims, 5 Drawing Figures

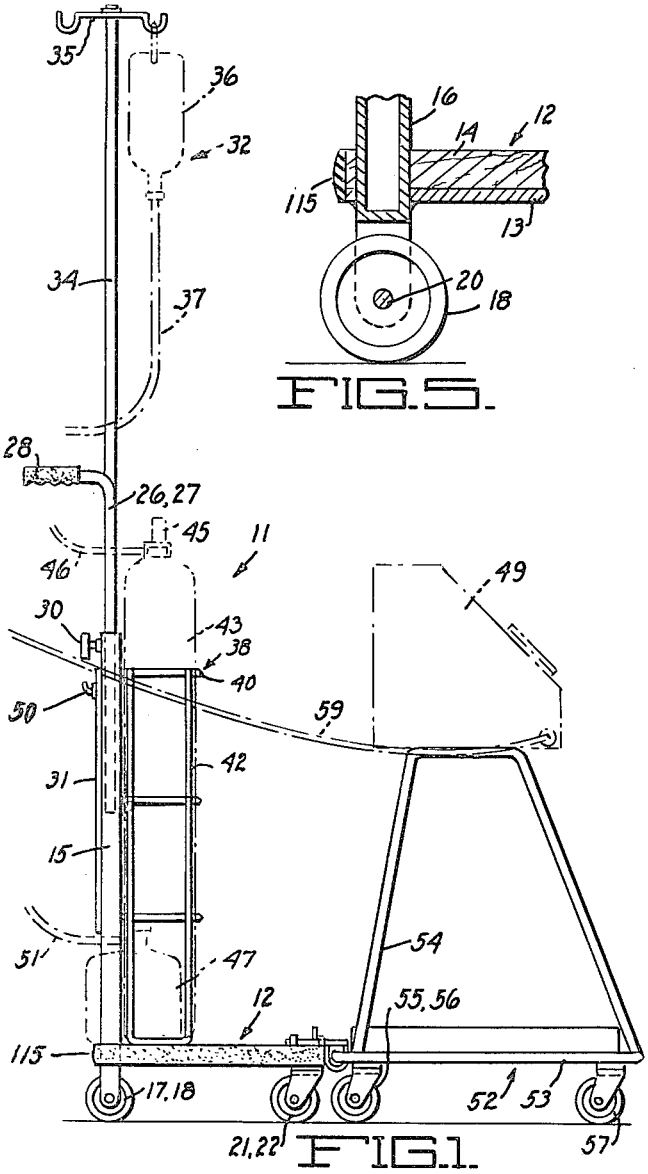
FIG. 1.
FIG. 5.
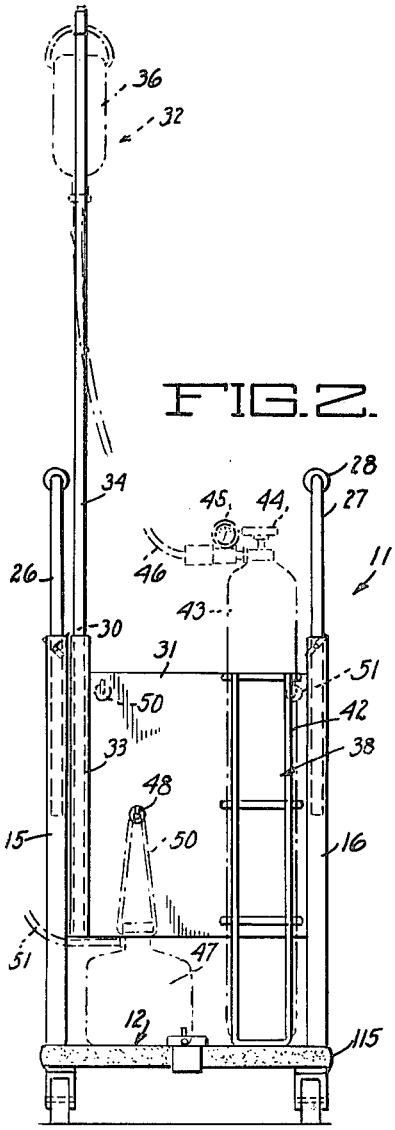
FIG. 2.
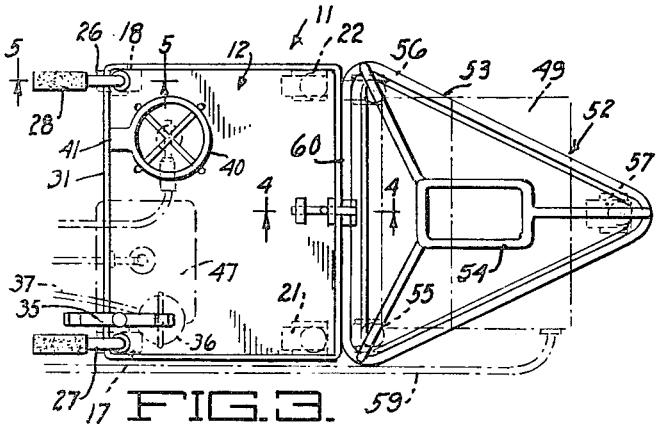
FIG. 3.
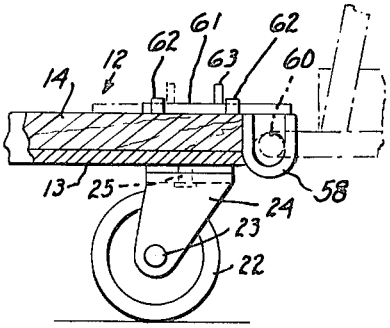
FIG. 4.

APPARATUS FOR AIDING PATIENTS TO AMBULATE

BACKGROUND OF THE INVENTION

1. Field of the Invention

This invention relates to apparatus for aiding infirm or convalescing patients to walk and has particular reference to a mobile apparatus for steadying a patient and for supporting various body servicing devices which must be connected to the patient while the patient is walking.

2. Description of the Prior Art

It has long been known that infirm patients or those convalescing from surgical operations or serious illness progress in health at a much faster rate if allowed to exercise by walking about at different times, particularly after being bedridden for a period of time.

Such patients must generally be assisted by one or more nurses until they are strong enough to safely walk by themselves. Also, in general, many of such patients must have one or more body servicing devices connected to them at all times during their convalescence, usually by flexible tubes, and such devices must, therefore, accompany the patients as they walk about. Examples of such body servicing equipment are intravenous feeding devices, oxygen supply tanks, urine collecting containers, lung drainage devices, etc. Since such equipment may be heavy and bulky, additional nurses (in come cases as many as four nurses) may be required to both assist the patient and carry the various pieces of equipment. Obviously, this requires nurses to take time out from more important duties and this, therefore, greatly increases the general cost of patient care and convalescence both in hospitals and elsewhere.

Although wheeled carriers or carts have been used heretofore for supporting different types of body servicing devices, such carriers of which we are aware still usually require the services of one or more nurses to maneuver the same as well as to aid the patient.

SUMMARY OF THE INVENTION

It therefore becomes a principal object of the present invention to provide an ambulating aid for an infirm or convalescing patient, while reducing the need for human assistance by the patient while walking about.

Another object of the invention is to enable an infirm or convalescent patient to walk about, even when encumbered by one or more body servicing devices.

Another object is to provide a patient ambulating aid of the above type which will support both the patient and one or more body servicing devices while enabling the same to be easily maneuvered by the patient.

A further object is to provide a patient ambulating aid, including a carrier for one or more body servicing devices, to which an additional carrier can be attached, while enabling both carriers to be easily manipulated as a single unit by the patient.

A still further object is to provide a patient ambulating aid of the above type which is inexpensive, compact and yet may be safely maneuvered by an infirm or convalescent patient.

According to the present invention, a compact patient ambulating aid is provided comprising a platform supported by uncastered rear wheels and castered front wheels. A vertical frame is secured to the rear of the platform and contains handles which the patient can grip to both help support or steady himself and to enable the patient to maneuver the apparatus. Means are provided for supporting various body servicing devices on both the platform and the frame whereby such devices may be connected through suitable flexible tubing to the patient for servicing him while he is walking about. Means are also provided for selectively attaching additional wheeled equipment, such as a carrier for an additional body servicing device, to the platform so that it may be propelled and maneuvered by the patient, along with the platform.

BRIEF DESCRIPTION OF THE DRAWINGS

The manner in which the above and other objects of the invention are accomplished will be readily understood on reference to the following specification when read in conjunction with the accompanying drawing, wherein:

FIG. 1 is a side view of a patient ambulating aid embodying a preferred form of the present invention. FIG. 1 also illustrates a wheeled auxiliary carrier attached to the apparatus for supporting a body servicing device.

FIG. 2 is a front view of the patient ambulating aid, illustrating the same without the auxiliary carrier attached thereto.

FIG. 3 is a top plan view of the patient ambulating aid with the auxiliary carrier attached thereto.

FIG. 4 is an enlarged fragmentary sectional view taken along line 4—4 of FIG. 3.

FIG. 5 is an enlarged fragmentary sectional view through one of the rear wheel supports and is taken along the line 5—5 of FIG. 3.

DESCRIPTION OF THE PREFERRED EMBODIMENT

While this invention is susceptible to embodiment in many different forms, there is shown in the drawing and will be described in detail, one specific embodiment, with the understanding that the present disclosure is to be considered as an exemplification of the principles of the invention and is not intended to limit the invention to the embodiment illustrated. The scope of the invention will be pointed out in the appended claims.

Referring to the drawing, the ambulating aid apparatus is generally indicated at 11 and comprises a platform generally indicated at 12 formed by a relatively heavy metal plate 13, FIGS. 4 and 5, on which is suitably secured a floor piece 14 of wood or the like. A rubber bumper strip 115 is secured around the edge of the platform 13.

Two vertically extending tubular posts 15 and 16 pass through the platform 12 adjacent the rear and side edges thereof and are suitably rigidly secured to the plate 13, as by welding. Each post is bifurcated at the lower end thereof to receive one of two rear supporting wheels 17 and 18. Each wheel is rotatably mounted on an axle 20 carried by the bifurcated ends of the respective post. Thus, the rear wheels 17 and 18 are uncastered.

The platform 12 is supported at its forward end by castered wheels 21 and 22, also located adjacent opposite side edges of the platform. Each of the wheels 21 and 22 is rotatably mounted on an axle 23 carried by a caster 24 which is arranged to swivel about a vertical axis on a pivot pin 25 carried by the platform plate 13.

From the above it will be seen that the relatively heavy plate 13 serves as a rigid support of the posts 15 and 16 and also serves, by virtue of its weight, to lower the center of gravity to reduce the possibility of tipping in the event the apparatus encounters an obstacle while being moved about.

L-shaped handle members 26 and 27 are provided to both support or steady the patient and to enable him to readily maneuver the apparatus in any direction he wishes to go. Each handle member is telescopically fitted in the upper end of a respective one of the posts 15 and 16 and has a rearwardly extending portion on which a handle grip 28 of rubber or the like is mounted. Lock screws 30 are threaded into the upper ends of the posts 15 and 16 to lock the associated handle members 26 and 27 in different vertically adjusted positions to accommodate patients of different heights.

A vertical panel 31 is suitably secured along its opposite side edges, as by welding, to the posts 15 and 16 to both reinforce the posts against flexing and to form a support for several body servicing devices, to be described presently. Panel 31 is spaced somewhat above the platform 12. Thus, the panel 31 and posts 15, 16 form a vertical frame to which the handle members 26 and 27 are attached.

For the purpose of supporting an intravenous feeding device, generally indicated by dot-dash lines 32, in proper elevated position relative to the patient, a vertically extending tubular socket 33 is welded or otherwise secured to the panel 31 adjacent the post 15. A pole 34 is slidably fitted in the socket 33 and carries a hook member 35 at the upper end thereof to support a bottle 36 carrying an intravenous feeding solution in inverted position. A flexible tube 37, preferably of plastic, is connected between the mouth of the bottle 36 and a suitable connection (not shown) on the patient's body.

An oxygen tank holder, generally indicated at 38, is also suitably attached, as by welding, to the panel 31 adjacent the post 16. The holder 38 comprises three vertically aligned rings 40, each suitably secured at 41, FIG. 3, to the panel 31. Vertical reinforcing rods 42 are secured, as by welding, to the rings to form a rigid cage into which an oxygen tank, depicted by dot-dash lines 43, may be slid vertically.

The tank 43 thus rests on the platform 12 and has the usual control devices attached to the upper end thereof, including, for example, a control valve 44 and a pressure indicating gauge 45. A flexible tube 46 may be connected in a manner not shown between the tank 43 and a suitable inhaling connection to the patient's nose or mouth.

The apparatus is also arranged to support a urine collecting device, such as is well-known in the art as a Foley bag, shown by dot-dash lines 47. Such bag is formed of plastic and rests on the platform 12, but is supported in upright position by a hook 48 secured to the panel 31, the hook suspending a cord 50 attached to the mouth of the bag 47. A flexible tube 51 is connected between the mouth of bag 47 and a catheter, not shown, attached to the patient.

By spacing the panel 31 a distance above the platform 12, as indicated in FIG. 2, the bag 47 may be located substantially directly below the panel whereby the cord 50 may apply a substantially direct vertical pull against the upper end of the bag to hold it in upright condition even when filled.

The rear panel 31 and platform 12 may be used to support other body servicing devices, not shown. For example, hooks 50 and 51 are mounted on the rear of the panel 31 from which may be suspended a chest drainage device, commonly known as a Pleurovac, not shown, manufactured by Dek Natel, which may be connected by a suitable flexible tube to the patient's chest.

It will be noted that the body servicing devices of greatest weight, such as the urine collecting bag 47 and the oxygen tank 43, are supported on the platform 12 and are held in proper upright position by the panel 13, thereby maintaining the center of gravity of the entire apparatus 11 as low as possible to reduce the possibility of tipping. On the other hand, it will be noted that the apparatus is extremely compact and thus will offer a minimum amount of obstruction to traffic in hospital corridors and the like, as well as taking up a minimum amount of storage space.

An auxiliary carrier, generally indicated at 52, is provided which may be removably attached to the front of the platform 12 to carry an additional servicing device, such as a chest drainage apparatus, generally indicated at 49. Such apparatus, commonly known as an Emerson suction device manufactured by J. H. Emerson Co. of Cambridge, Massachusetts, may be connected to the patient's lungs by a flexible tube 59.

The carrier 52, which per se forms no part of the present invention, comprises a tubular metal frame 53 which is triangular when viewed from the top and has upwardly extending frame portions 54 arranged to support the device 49.

Three castered wheels 55, 56 and 57, similar to the castered front wheels 21 and 22, support the frame 53 for movement in any direction.

Means are provided to removably attach the carrier 52 in abutting engagement with the forward edge of the platform 12 to permit the patient to maneuver both the platform and the carrier 52 as a single unit. For this purpose, a U-shaped hook 58 is suitably secured to the front edge of the plate 13, as by welding.

In order to couple the carrier 52 to the platform 12, the rear cross frame element 60 of carrier 52 is merely fitted over the hook 58, as indicated in dot-dash lines in FIG. 4.

Means are provided for removably locking the carrier 52 in coupled relation to the platform 12 and, for this purpose, a slide latch bolt 61 is slidably mounted in bearings 62 suitably secured to the upper surface of the platform floor 14. Bolt 61 may be grasped by means of a knob 63 and slid from its open dotted line position in FIG. 4 to its full line closed position to lock the carrier 52 in place. In cases where the device 49 is not needed, the carrier can be readily separated from the platform by sliding the bolt 61 to its open position and then lifting the carrier 52 slightly to uncouple the same from the hook 58.

It will be obvious that not all of the aforementioned body servicing devices may be needed for any one patient at any one time and, therefore, such devices may be readily removed from the apparatus. In fact, in some cases, the apparatus may be used solely as an ambulatory aid to help support or steady the patient while exercising and, in that event, all of the body function aids may be removed.

I claim:

1. Apparatus for aiding an infirm patient to ambulate while being connected to at least one body servicing device, comprising a platform, a pair of laterally spaced tubular posts extending vertically through said platform adjacent the rear of said platform and fixedly secured to said platform, the lower ends of said posts being bifurcated, a first pair of wheels rotatably mounted in said bifurcated ends of said posts for supporting the rear of said platform, a second pair of laterally spaced supporting wheels, castering means rotatably mounting said second pair of wheels to said platform adjacent the front of said platform for swiveling about vertical axes, handle members telescopically mounted on the upper ends of said posts, said handle members extending rearwardly to be grasped by said patient to steady said patient in walking condition and to enable said patient to maneuver said platform, means for locking said handle members in different vertically adjusted positions relative to said posts, a vertically extending panel extending between said posts, said panel being spaced above said platform, and means on said panel for maintaining said body servicing device in upright position below said panel with the bottom of said device resting on said platform.

2. Apparatus for aiding an infirm patient to ambulate while being connected to a body servicing device, comprising:

a platform;

a mobile support for said platform including uncastered rear wheel means and castered front wheels;

an upstanding frame comprising a pair of laterally spaced vertically extending posts attached at the lower ends thereof to said platform adjacent the rear of said platform and a panel mounted between said posts;

a pair of laterally spaced handle members and means for attaching said handle members to respective ones of said posts so that they extend rearwardly from said frame to be grasped by said patient for supporting said patient in walking condition and for enabling said patient to maneuver said platform; and means on said panel for maintaining said body servicing device in upright position and in cooperating relation with said patient;

said body servicing device being a urine collecting container; and said panel being spaced above said platform and said maintaining means on said panel comprising means for maintaining said urine collecting container in upright position below said panel with the bottom of said container resting on said platform.

3. Apparatus for aiding an infirm patient to ambulate while being connected to a body servicing device, comprising:

a platform;

a mobile support for said platform including uncastered rear wheel means and castered front wheels;

an upstanding frame comprising a pair of laterally spaced vertically extending posts attached at the lower ends thereof to said platform adjacent the rear of said platform and a panel mounted between said posts;

a pair of laterally spaced handle members and means for attaching said handle members to respective ones of said posts so that they extend rearwardly from said frame to be grasped by said patient for supporting said patient in walking condition and for enabling said patient to maneuver said platform; and first means on said panel for maintaining said body servicing device in upright position and in cooperating relation with said patient;

said body servicing device being an oxygen tank;

said first maintaining means comprising a plurality of vertically aligned horizontally disposed rings attached to said panel for receiving said oxygen tank for connection to said patient and retaining it in said upright position;

said tank to be supported by said platform;

said panel being spaced above said platform and said apparatus having second means on said panel for maintaining a urine collecting container in upright position below said panel with the bottom of said container resting on said platform.

* * * * *

UNITED STATES PATENT AND TRADEMARK OFFICE

CERTIFICATE OF CORRECTION

PATENT NO. : 4,266,765

DATED : May 12, 1981

INVENTOR(S) : Narciso Sandoval and Jean L. Curten

It is certified that error appears in the above-identified patent and that said Letters Patent are hereby corrected as shown below:

After [76] on title page, the address of both inventors should read 4340 Eleventh Street, Riverside, Calif. 92501.
Column 1, line 30, "come" should read --some--.

Signed and Sealed this

*Thirteenth* Day of *October 1981*

[SEAL]

*Attest:*

GERALD J. MOSSINGHOFF

*Attesting Officer*

*Commissioner of Patents and Trademarks*